United States Patent [19]

Wyckoff

[11] 4,345,023

[45] Aug. 17, 1982

[54] PROCESS FOR INCREASING THE EFFECTIVE SPEED OF PHOTOGRAPHIC FILMS AND IMPROVED FILM STRUCTURES

[75] Inventor: Charles W. Wyckoff, Needham, Mass.

[73] Assignee: The Academy of Applied Science, Inc., Belmont, Mass.

[21] Appl. No.: 225,534

[22] Filed: Jan. 16, 1981

Related U.S. Application Data

[63] Continuation of Ser. No. 943,319, Sep. 18, 1978, abandoned.

[51] Int. Cl.[3] ..... G03C 7/00

[52] U.S. Cl. ..... 430/364; 430/366; 430/373; 430/393

[58] Field of Search ..... 430/17, 366, 372, 393, 430/373, 364

[56] References Cited

U.S. PATENT DOCUMENTS

| | | | |
|---|---|---|---|
| 2,229,137 | 1/1941 | Schneider | 430/366 |
| 2,249,542 | 3/1941 | Schinzel | 430/366 |
| 2,623,822 | 12/1952 | Duerr | 430/367 |
| 2,737,457 | 3/1956 | Childress | 430/366 |
| 3,776,727 | 12/1973 | Nassenstein et al. | 430/1 |
| 3,923,511 | 12/1975 | Bissonette | 430/373 |
| 4,183,750 | 1/1980 | Goldberg | 430/364 |
| 4,192,681 | 3/1980 | Fujiwhara et al. | 430/373 |

*Primary Examiner*—J. Travis Brown

*Attorney, Agent, or Firm*—Rines and Rines, Shapiro and Shapiro

[57] ABSTRACT

A process is disclosed for enhancing the speed of both certain black and white and color films, through initial black-and-white development, and redevelopment with color coupling developers and color coupling dye units, and replacement of silver units with multiple color dye units for each silver unit that provide a color image enhanced over that provided by the silver image.

5 Claims, No Drawings

PROCESS FOR INCREASING THE EFFECTIVE SPEED OF PHOTOGRAPHIC FILMS AND IMPROVED FILM STRUCTURES

This is a continuation application of Ser. No. 943,319, filed Sept. 18, 1978, now abandoned.

The present invention relates to photographic film processing and film structures, being more particularly concerned with processes for increasing the effective "speed" of such films (defined in terms of the minimum energy required to record a detectable image), and improved film structures resulting from the same.

The primary ways in which photographic films have heretofore been rendered more sensitive or of increased speed, are as follows. First, the size of the silver halide crystals in the light-sensitive emulsion has been increased to increase the probability of photon absorption. Secondly, the crystals may be chemically sensitized during preparation to increase the efficiency of electron-trapping, as electrons are released upon photon impact. Thirdly, in the processing, more efficient reducing agents have been employed to discriminate between exposed and non-exposed crystals.

One of the common methods of rating the photographic speed of film is in terms of the minimum camera exposure required to produce a recorded threshold image. This is expressed in terms of relative ASA speed ratings, the highest value of which represents the film of the fastest or greatest speed. Present-day techniques permit ASA ratings of the order of 2000 for very high-speed black and white negative films, and of the order of 400–500 for high-speed reversal color films. In order to increase the effective speed of the said negative type film, prolonged development may be employed to increase the slope of the density versus log of exposure characteristic curve (D-Log E) near the toe of the curve, but with a sacrifice of quality in the reduction of the available exposure range or latitude and fogging. Factors of two to three in effective speed increase can, however, thus be obtained. Forced development of reversal color films will also produce an apparent increase in speed, for strong images, but actually no increase in the image-recording threshold at the toe of the D-Log E curve or the shoulder of its reversal curve.

Underlying the present invention, however, is the startling discovery of a process with which each of black and white negative, color reversal and negative films and the like can be processed to increase their effective speeds to degrees previously unattainable, and with minimal sacrifice of quality and exposure latitude, and with very substantial boosting or amplification of threshold image-recording in the toe of the D-Log E characteristic. This has opened up new opportunities in photo-instrumentation, particularly in underwater applications, as in peat-stained lakes, where light attenuation may be severe and the range of photography most limited.

An object of the invention, accordingly, is to provide a new and improved process for increasing the effective speed of photographic films that is not subject to the above-described and other limitations of prior techniques.

A further object is to provide novel photographic film structures associated with the high photographic speeds obtainable with such process.

Other and further objects will be explained hereinafter and are more particularly delineated in the appended claims. In summary, one aspect of the invention embraces a process for increasing the effective speed of a photographic film and the like, that comprises, developing an exposed film with black and white developer and fixing the same to isolate the exposed photosensitive film crystals as a reduced silver image; bleaching or re-halogenating said reduced silver image to convert the same to a soluble silver complex or silver halide; re-developing the film in a color-coupling developer in the presence of color-coupling dye units to reduce the image to silver units and proximal color units with multiple color units for each silver unit; converting the silver units to a soluble silver complex; fixing the film to remove all traces of the silver; and washing and drying the film.

Preferred details and other aspects of the invention are hereinafter presented.

EXAMPLE 1

Turning, first, to the application of the invention to black and white negative film, it will be recalled that the D-Log E characteristic curve shows a long, just slightly rising, almost horizontal toe emerging into a constant steep slope region which then shoulders off in saturation. The threshold of image recording lies within the almost horizontal toe. While, as before stated, prior techniques of forced development will somewhat tilt the toe upward to provide a lower effective image-recording threshold, this is limited by the inherent development of all silver-halide crystals (whether exposed or not) and the consequent fogging with resultant loss in effective overall film speed.

In accordance with the invention, the black and white negative film (such as Kodak 2475 Recording Film, a product of Eastman Kodak Company) is first force-developed (processed with extended development) in conventional black and white developer (such as phenyl methyl pyrazolidone) to produce maximum speed with minimum fog. It has been found to be preferred for the purposes of the invention that the temperature be maintained cool, around 75° F., and the time of the developing of the order of 12 minutes. The film is then fixed by dissolving out the undeveloped silver halide crystals, as with sodium thiosulphate, leaving only the final reduced silver image. Following washing, the reduced silver image is completely converted to a soluble silver halide or complex by re-halogenation or bleaching with a bleaching agent, such as potassium ferri-cyanide.

After washing, the film is re-developed, but this time in a color-coupling developer such as 4-amino-N-ethyl-N-(B Methanesulfonamidoethyl)-m-toluidine sesquisulfate monohydrate (sold, for example, by Eastman Kodak under type "Color Developing Agent CD-3), to which has been added a color-coupling agent such as 2, 4-Dichloro-1-naphthol (cyan or blue-green), or any similar desired color dye. This re-developing stage is allowed to proceed to completion (of the order of about eight minutes at room temperature), reducing the image to silver and, in this case, blue-green color dye proximal to the silver. The color-coupling developer is removed by washing, and the silver is again completely converted to a soluble silver complex with the above-mentioned re-halogenation or bleaching agent, following which the film is fixed; as before described, this time to remove all traces of silver. The film is then washed and dried.

It has been found that this process enables undetectable images in the film after the first development step, now to be clearly indicated, this time in the color of the color-coupling agent. Otherwise stated, the threshold of detectable image-recording has been markedly lowered, with the image manifesting itself by the color dye. What appears to have happened is that, if the right proportions are used, each exposed silver unit can be replaced by a number of color dye units; multiple dye units being more visible than a single silver unit that they replace. In the above example, 6 units of color coupling agent were used for every 2 units of the CD-3 color-coupling developer, producing an image speed increase of a factor of four. Such proportions represent, of course, radical departures from those used for other objectives in usual color film development (such as 3 units of CD-3 for 2 units of color coupling, as in Kodak's "Kodachrome" developing procedures).

Returning to the D-Log E curve, the almost horizontal toe, representing few exposed silver units, has been effectively turned upward with a greater slope corresponding to this amplication or effective enhancement, and thus providing an effective increase in photographic film speed, without the relatively rapid fogging density effect in ordinary prior prolonged development processes, before mentioned.

By this technique, the exemplary 2475 film ASA rating of about 2000 has been startingly boosted to about 8000 and above, even up to ASA ratings of the order of 20,000.

EXAMPLE 2

The steps of Example 1 have been repeated, but increased contrast for the faintest images has been obtained by then re-cycling or repeating the soluble silver complex/color-coupling re-developing and subsequent steps. The contrast has been found to be approximately doubled with such a re-cycling procedure.

EXAMPLE 3

Color film, (Kodak "Ektachrome" VNX, ASA 400), has been successfully rendered as a color negative and provided with greatly increased speed by the process of the invention.

The exposed color film was first developed in a black-and-white phenyl methyl pyrazolidone developer (about 5 minutes at 70° F.) and then fixed to produce a black and white negative. After washing, the reduced silver image was converted completely to a soluble silver complex as in Example 1.

Following washing, the film was re-developed, this time in the color-coupling developer of Example 1, but without the addition of the color coupling agent in view of the presence of color-coupling dye units already incorporated in each layer of the film.

The silver is again converted to the soluble silver complex by the re-halogenating or other bleaching agent of Example 1, and the film is fixed, washed and dried, resulting in a full true color negative image with vastly increased speed.

By re-cycling the soluble silver complex/re-developing and bleaching or re-halogenating and fixing steps, an ASA of 20,000 was attained.

Photographs taken by strobe lighting of objects at distances of the order of thirty feet in the heavy peat-stained waters of Loch Ness, Scotland, and completely undetectable in the black and white negative stage, became for the first time readily apparent in the color negative thus processed.

There are instances, moreover, such as where color discrimination is not important, wherein the silver units may be kept in the developed product together with the proximal color units achieved by the color-coupling developer re-developing step. An example of such follows as:

EXAMPLE 4

The steps of Example 1 are repeated up to and including the re-development in the color-coupling developer CD-3 with the added cyan color-coupling agent. The color-coupling developer is then washed out and the film is then dried.

This can be re-halogenated with a re-cycling of the color-coupling developing step to attain even greater gain as contrast.

While the invention has been described in connection with particular examplary films, it is to be understood that the process is equally useful with other films of similar or related characteristics, and that further modifications occurring to those skilled in this art will similarly fall within the spirit and scope of the invention as defined in the appended claims.

What is claimed is:

1. A process for increasing during development the effective speed of an exposed silver-sensitized photographic film and the like by a factor of at least 4 to 10 times the ASA speed rating, that comprises developing and fixing the exposed film to provide a reduced silver image; re-halogenating or bleaching said reduced silver image to convert the same to a silver halide or soluble silver complex; and re-developing the film in a color-coupling developer in the presence of color-coupling dye units to reduce the image to silver units and proximal color units, each of the last-mentioned silver units having multiple proximal color units associated therewith as the result of (1) providing of the order of 6 color-coupling dye units in the color-coupling developer for every 2 units of color-coupling developer or (2) repeating the re-halogenating or bleaching and subsequent re-developing a sufficient number of times in the presence of sufficient color-coupling dye units to produce the speed increase.

2. The process as claimed in claim 1, wherein the last-mentioned silver units are removed from the film and the film is washed and dried.

3. The process as claimed in claim 1, wherein the film is washed and dried with the last-mentioned silver units remaining in the film.

4. The process as claimed in claim 1, wherein the film is a black and white type and said color-coupling dye units are present in the color-coupling developer.

5. The process as claimed in claim 1, wherein the film is a color type with the color-coupling dye units incorporated in the film, and wherein the association of silver units with multiple color units is accomplished by repeating the re-halogenating or bleaching and subsequent re-developing steps.

* * * * *